US010500635B2

(12) United States Patent
Røen et al.

(10) Patent No.: US 10,500,635 B2
(45) Date of Patent: Dec. 10, 2019

(54) EQUIPMENT FOR CONTINUOUS OR SEMI-CONTINUOUS CASTING OF METAL WITH IMPROVED METAL FILLING ARRANGEMENT

(71) Applicant: NORSK HYDRO ASA, Oslo (NO)

(72) Inventors: Geir Atle Røen, Kvanne (NO); Daniel Anders Sjølset, Sunndalsøra (NO); Arild Håkonsen, Sunndalsøra (NO); Rune Ledal, Sunndalsøra (NO); John Erik Hafsås, Sunndalsøra (NO); Ulf Håkon Tundal, Sunndalsøra (NO)

(73) Assignee: NORSK HYDRO ASA, Olso (NO)

( * ) Notice: Subject to any disclaimer, the term of this patent is extended or adjusted under 35 U.S.C. 154(b) by 122 days.

(21) Appl. No.: 15/740,922

(22) PCT Filed: May 23, 2016

(86) PCT No.: PCT/NO2016/000017
§ 371 (c)(1),
(2) Date: Dec. 29, 2017

(87) PCT Pub. No.: WO2017/007329
PCT Pub. Date: Jan. 12, 2017

(65) Prior Publication Data

US 2018/0185907 A1 Jul. 5, 2018

(30) Foreign Application Priority Data

Jul. 3, 2015 (NO) ..... 20150869

(51) Int. Cl.
*B22D 11/103* (2006.01)
*B22D 11/18* (2006.01)
(Continued)

(52) U.S. Cl.
CPC ..... *B22D 11/103* (2013.01); *B22D 7/005* (2013.01); *B22D 9/003* (2013.01); *B22D 11/003* (2013.01);
(Continued)

(58) Field of Classification Search
CPC ..... B22D 11/049; B22D 11/10; B22D 11/103; B22D 11/18; B22D 35/04; B22D 37/00
See application file for complete search history.

(56) References Cited

U.S. PATENT DOCUMENTS 3,552,478 A 1/1971 Lauener et al.
3,658,119 A * 4/1972 Hunt ..... B22D 11/113 164/512
(Continued)

FOREIGN PATENT DOCUMENTS

| | | |
|---|---|---|
| EP | 1 648 635 | 4/2009 |
| JP | 1-148447 | 6/1989 |
| WO | 2011/056078 | 5/2011 |

OTHER PUBLICATIONS

International Search Report dated Sep. 27, 2016 in International (PCT) Application No. PCT/NO2016/000017.

*Primary Examiner* — Kevin E Yoon
(74) *Attorney, Agent, or Firm* — Wenderoth, Lind & Ponack, L.L.P.

(57) ABSTRACT

An apparatus for continuous or semi-continuous low pressure casting of metal, in particular directly-cooled (DC) casting of extended objects such as a rods, bars or billets of aluminium. The apparatus includes a frame construction with at least one chill or mould having a mould cavity that is provided with an upwardly open inlet and an outlet with cooling means. The inlet of the mould is connected to a distribution chamber receiving liquid metal from a metal store such as a holding furnace via a metal supply channel or launder. A flexible launder section is provided between
(Continued)

the launder and the metal distribution chamber whereby the frame construction with the moulds and distribution chamber can be raised and lowered to enable complete filling of metal to the moulds. Subsequently it is possible to control the metal level in each respective mould cavity in relation to the metal level in the launder and thereby controlling the low pressure casting.

8 Claims, 3 Drawing Sheets

(51) Int. Cl.

| | |
|---|---|
| ***B22D 35/04*** | (2006.01) |
| ***B22D 7/00*** | (2006.01) |
| ***B22D 9/00*** | (2006.01) |
| ***B22D 11/00*** | (2006.01) |
| ***B22D 11/049*** | (2006.01) |
| ***B22D 18/04*** | (2006.01) |

(52) U.S. Cl.
CPC ..... *B22D 11/049* (2013.01); *B22D 11/18* (2013.01); *B22D 18/04* (2013.01); *B22D 35/04* (2013.01)

(56) References Cited

U.S. PATENT DOCUMENTS

| | | | | |
|---|---|---|---|---|
| 7,445,037 | B2 * | 11/2008 | Heggset | B22D 11/147 164/487 |
| 8,413,711 | B2 * | 4/2013 | Vaagland | B22D 11/10 164/487 |
| 2005/0126744 | A1 * | 6/2005 | Salee | B22D 11/103 164/483 |
| 2013/0292427 | A1 * | 11/2013 | Cooper | B22D 37/00 222/594 |

* cited by examiner

EQUIPMENT FOR CONTINUOUS OR SEMI-CONTINUOUS CASTING OF METAL WITH IMPROVED METAL FILLING ARRANGEMENT

The present invention concerns equipment for continuous or semi-continuous casting of metal, in particular direct chill (DC) casting of aluminium, comprising a mould with a mould cavity or chill that is provided with an inlet linked to a metal store and an outlet with devices for cooling the metal so that an object in the form of an extended string, rod or bar is cast through the outlet.

Equipment of the above type is widely known and used for casting alloyed or unalloyed aluminium metal that is processed further down the production chain, for example for remelting or extrusion purposes.

A major challenge for this type of prior art casting equipment has been to achieve a segregation-free, smooth surface on the product cast. This has been particularly important for products in which the surface is not removed before processing. In the applicants own EP patent No. 1648635 is shown and described a method and equipment for continuous or semi-continuous casting of metal where the disadvantages of inverse segregation and blooms in the metal are considerably reduced or eliminated. Moreover, the EP patent shows a prior art solution which is much safer during the casting operation. Furthermore, this known equipment and method makes it possible to control the metal level in the chill(s), i.e. the metal level in relation to primary and secondary cooling zones, making it simple to adapt the casting operation to the alloy to be cast. This known solution, now known as low pressure casting (LPC) is characterised by the metal being supplied to the chill in such a manner and with such control that the metallostatic pressure in the contact point (solidification zone) against the chill is virtually zero during casting. However, the known solution according to EP 1648635 has proved to be difficult to control during start-up of the casting operation and the equipment requires an extra intermediate metal reservoir as is further explained below.

With the present invention is provided an improved casting equipment for the casting of ingots where the filling of metal at start-up of the casting operation is improved and simplified and where the equipment as such is simpler and more safe and easier to control.

The present invention is characterized by the features as defined in the independent claim 1.

The dependent claims 2-4 define advantageous features of the present invention.

The present invention will be described in further detail in the following by means of examples and with reference to the attached drawings, where:

Figure 1:
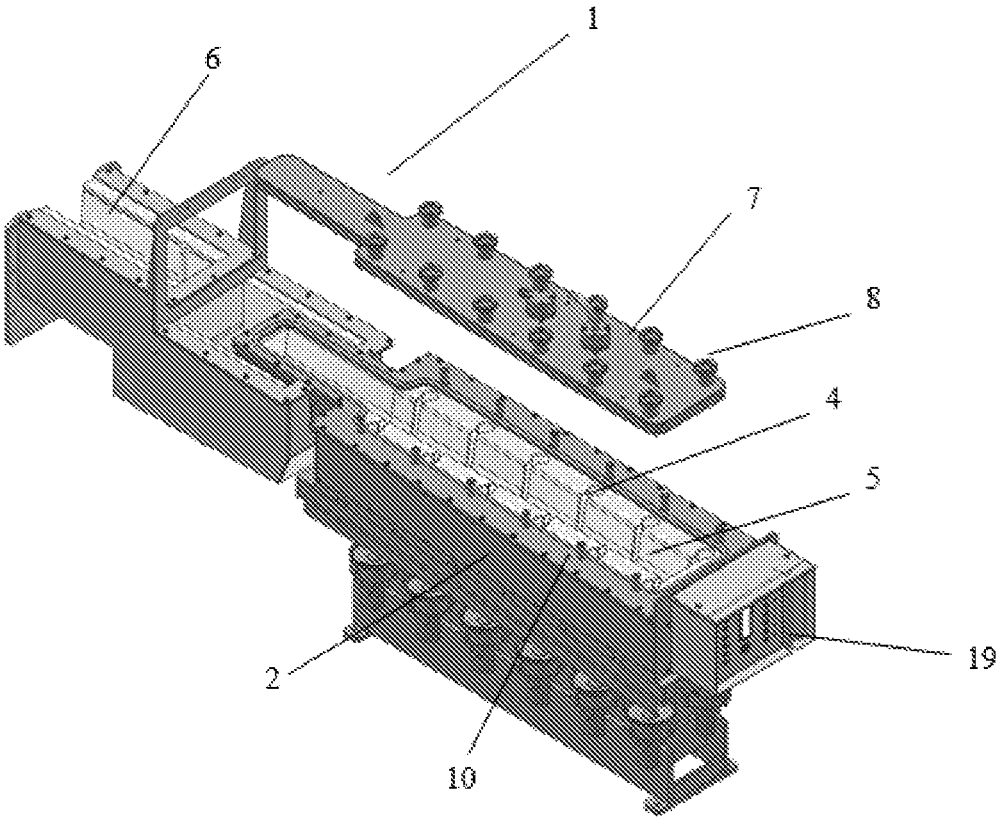
Prior Art Fig. 1
FIG. 1 shows a perspective view, partially seen from the side and from the front, of the prior art LPC casting equipment according to EP 1648635 in which a cover that is designed to close the equipment from above is kept open so that it is possible to see partially into the thermally insulated metal supply duct.
Figure 2:
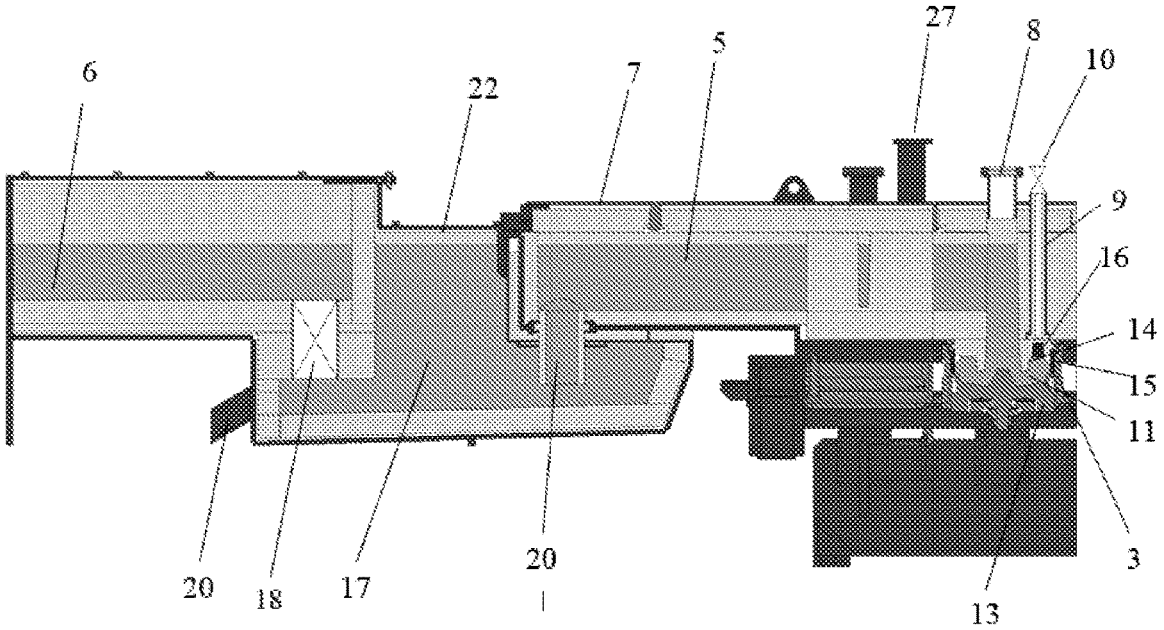
Fig. 2 Prior Art
FIG. 2 shows an elevation of the equipment shown in FIG. 1 in which liquid metal is supplied to the equipment during the start-up of a casting operation.
Figure 3:
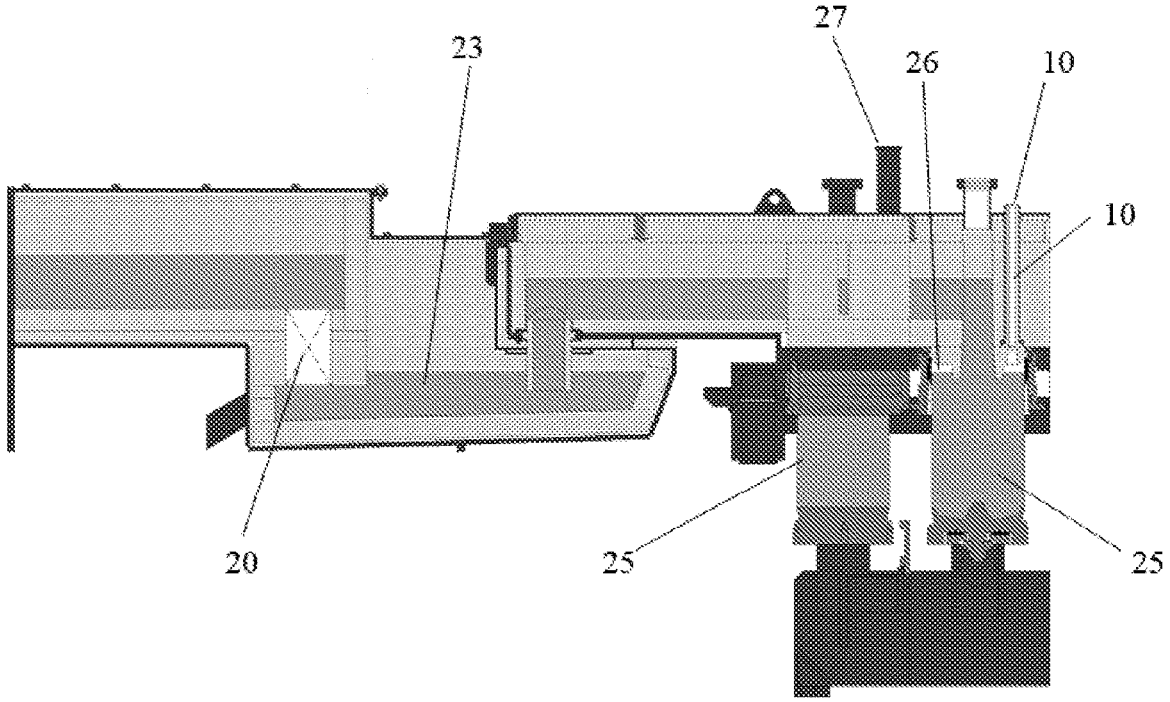
Fig. 3 Prior Art
FIG. 3 shows the same view as in FIG. 2, but where the equipment is in casting mode and pressure in the mould is controlled by the liquid metal level in the intermediate reservoir.

As stated above, FIGS. 1-3 shows an example of a known casting equipment for casting extrusion ingots as shown the applicant's own EP patent No. 1648635 on which the present invention is based. It is simple in the sense that it only comprises six chills or moulds 3 with metal inlets 4. This type of equipment may comprise far more chills, up to a few hundred, depending on their diameter, among other things, and may have the capacity to cast tens of tonnes of metal per hour.

Roughly speaking, in addition to the moulds, which are not shown in FIG. 1, the equipment comprises a frame structure 2 with a thermally insulated launder system 6 for the supply of metal from a metal reservoir (holding furnace or similar) and a correspondingly insulated distribution chamber (metal manifold) 5 for distribution of the metal to the respective chills. Over the distribution chamber 5, the equipment is provided with a removable lid or cover 7 that is designed to seal the distribution chamber from the surroundings. Pipe stubs 8 arranged in connection with the cover 7, which are used for inspection during casting, among other things, are connected to the inlet 4 for each chill 3 and are closed during casting, while the ventilation ducts 9 (see also FIGS. 2-3) that emerge in other pipe stubs with a closing device over the mould wall in the equipment are connected to the mould cavity 11 in the mould 3. At the end of the equipment, there is a control panel 19 that does not form part of the present invention and will not be described in further detail here.

As shown in further detail in FIG. 2, the known casting equipment concerns a vertical, semi-continuous solution in which a moving support 13 is used for each mould 3 to keep the mould closed at the bottom at the beginning of each cast. The moulds themselves are of the hot-top type in which a thermally insulating collar or projection 14 is used directly by the inlet to the mould cavity. Moreover, oil and gas are supplied through permeable rings 15 in the wall of the mould cavity 11. As stated above, a ventilation duct 9 is provided for each chill. This is closed by means of a closing device 10 or plug 16 at the beginning of each cast (see the relevant section below). Furthermore, a connection stub 27 is provided that is designed for connection to a vacuum reservoir (negative pressure reservoir or extraction system) so that a negative pressure can be applied to the distribution chamber 5 during casting (see the relevant section below).

The metal arrives through the launder 6 and is supplied to an intermediate reservoir 17 at a somewhat lower level via a valve device 19 (not shown in detail). The intermediate reservoir 17 is open at the top (at 22) but a duct 20 is designed to pass the metal to the distribution chamber 5, which is located at a higher level, and on to the chills or moulds 3. With this solution, where an intermediate reservoir 17 is provided at a lower level and where the metal is passed (sucked) from this level via the distribution chamber 5 to the mould cavity located at a higher level than the reservoir 17, the siphon principle is used to feed the metal to the chill. Thus it is also possible, by regulating the level in the intermediate reservoir 17, to control the level 26 (see FIG. 3) of the metal in the mould cavity 11 and thus also the contact point (solidification zone) against the mould wall. Therefore, by controlling the level in the reservoir 17, the level 26 in the mould cavity is also regulated, while the metallostatic pressure against the contact point 15 in the chill (mould cavity) is virtually zero. This is the "core" of the LPC casting principle and will be explained briefly in further detail in the following.

FIG. 2 shows the starting point of a casting operation. Metal is supplied from a store (not shown) via the launder 6, through the open valve device 18 to the intermediate reservoir 17, the distribution chamber 5 and the moulds 3 (only two moulds are shown in these figures for practical reasons). The lid 7 is fitted and the connection stub 27 is connected to the extraction system so that all air is evacuated. The launder 7, the intermediate reservoir 17 and the distribution chamber 5, including the moulds 3, are filled to the same level (the metal is shown with a darker grey colour). The ventilation pipe 9, which extends from the mould cavity 3, is closed by means of the closing device 10 and/or plug 16.

FIG. 2 shows a situation in which the casting operation has not yet started and the support 13 is kept tight against the outlet of the chill. The valve device 18 is open at this time but will gradually be closed. After the liquid metal has been supplied to the intermediate reservoir 17, the chills and the distribution chamber 5, and has entered equilibrium, the casting operation starts. The metal level in the reservoir 17 will now fall, while the metal level in the distribution chamber 5 will be maintained by means of the negative pressure (in relation to the environment) formed by means of extraction via the connection stub 27. A billet 25 is now formed by casting, as shown in FIG. 3. The closing device 10 and/or plug 16 for the ventilation pipe 9 are kept closed and prevent ventilation to the atmosphere until the metallostatic pressure in the mould 11 is equivalent to atmospheric pressure. The plug 16 is then removed and equilibrium exists between the metal level 23 in the reservoir 17 and the metal level 26 in the mould, with the result that metal will flow into the chill 3 when metal is supplied to the intermediate reservoir 17 from the supply launder 6.

FIG. 3 shows the ideal (balanced) casting situation in which the plug 16 has been removed and the valve 10 is open. There is equilibrium between the metal level 26 in the mould 3 and the metal level 23 in the intermediate reservoir 17. In this situation, the metallostatic pressure is virtually zero in the contact point of the metal against the mould. This is the essence of the LPC casting principle, namely that the metal is supplied to the mould in such a way and with such control that the metallostatic pressure in the contact point against the mould wall is virtually zero during casting.

Figure 4:
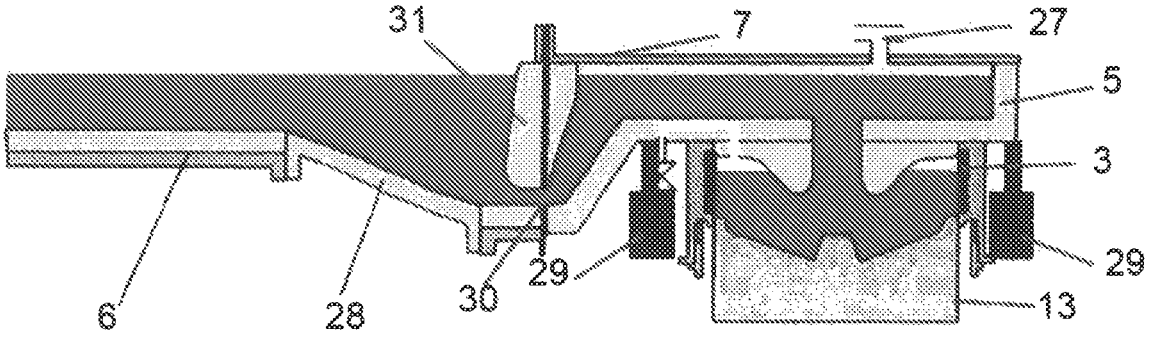
FIG. 4 shows in longitudinal cross section the casting equipment according to the invention during filling of metal to the casting mould during start-up.
Figure 5:
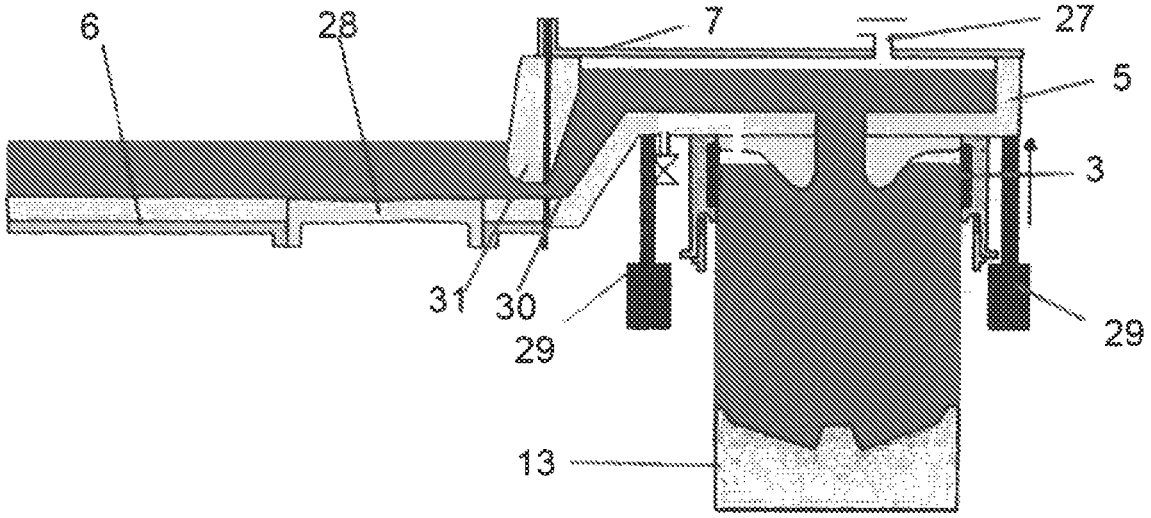
FIG. 5 shows a longitudinal cross section of the same equipment as shown in FIG. 4, but where the equipment is in casting mode.

The present invention is related to the LPC equipment as described above and shown in FIGS. 1-3. As with the known LPC equipment, the present invention is provided with a metal distribution chamber 5 as shown in FIGS. 4 and 5. The equipment further includes, like with the known equipment, a launder or metal supply channel 6 and a mould 3 (only one of many shown in the figure). A lid 7 is provided to close the distribution chamber 5, and the lid is further provided with a connection stub 27 for connection to vacuum reservoir (not shown) to enable evacuation of air from the distribution chamber. The major difference between the known solution as shown in FIGS. 1-3 and the present invention as shown in FIGS. 4-5 is, however, the provision of a flexible launder connection 28 between the metal supply launder and the distribution chamber 7 enabling relative movement of the casting table and metal supply launder. The flexible launder section may be made of a suitable heat resistant and heat insulating material. A preferred embodiment of such launder may be a combination of an inner ceramic cloth such as Nextel™ Woven Fabric 312 manufactured by 3M, an intermediate insulation material such as Superwool® 607 manufactured by Morgan and an outer reinforcing fiberglass cloth such as KlevoGlass™ 332-1produced by Klevers GmbH.

A lifting arrangement is provided to raise and lower the casting table with the distribution chamber 5 and mould 3. The lifting arrangement may preferably be a screw jack arrangement 29 provided at each corner of the frame construction of the casting equipment (not further shown). FIGS. 4 and 5 are just illustrations and do not show the casting table as such (the frame construction) or details related to the mould, distribution chamber or lifting arrangement.

The working principle of the invention is as follows: When starting a casting operation, the movable support 13 is in the uppermost position closing the downward opening of the continuous mould 3, as shown in FIG. 4. The casting table with the mould 3 is in its lower position whereby metal is allowed to freely flow from the holding furnace or the like (not shown) through the launder 6 and flexible launder 28 and to the distribution chamber 5 and mould 3 as is further shown in FIG. 4. Once the metal level in the distribution chamber and launder is the same, vacuum is gradually increased by controlling the vacuum supply through the connection 27, while at the same time raising the casting table with the mould 3 and distribution chamber 5 to a higher level by means of the lifting device 29 as shown in FIG. 5. The mould is now lifted to a height such that the metal level within the mould is the same as the level in the launder thereby obtaining a metallostatic pressure in the contact point against the mould wall which is virtually zero during casting the following casting operation as explained above. The whole casting cycle as explained in the forgoing is controlled by a so called PLC, a programmable logic control which will not be further explained here as this type electronic control is commonly known.

When the casting operation is approaching its end, the casting table with the mould and distribution chamber is lowered to its lower, initial position as shown in FIG. 4, the vacuum is disconnected and the metal is allowed to be returned to the holding furnace or metal reservoir. The metal frame may now be tilted (not shown) to remove the readily cast billets, where after the frame with the moulds are prepared for a new casting operation.

With this inventive modification of the know LPC equipment, the equipment as such is much cheaper and the casting operation is much more simple, safe and reliable.

The invention claimed is:

1. An apparatus (1) for continuous or semi-continuous low pressure casting of metal, including a frame construction with at least one mould (3) having a mould cavity that is provided with an upwardly open inlet (4) and an outlet with cooling means, the inlet of the mould being connected to a distribution chamber (5) receiving liquid metal from a holding furnace via a launder (6), wherein a flexible launder section (28) is provided between the launder (6) and the metal distribution chamber (5) whereby the frame construction with the at least one mould (3) and distribution chamber can be raised and lowered by means of a lifting arrangement to enable complete filling of metal to the at least one mould and subsequently to control the metal level in the respective mould cavity in relation to the metal level in the launder and thereby controlling the low pressure casting operation.

2. The apparatus in accordance with claim 1, wherein the flexible launder section (28) is made of a three layer composition including an inner heat resistant ceramic cloth, an intermediate heat insulation material and an outer reinforcing fiberglass.

3. The apparatus in accordance with claim 2,
wherein the frame construction with the at least one mould (3) and distribution chamber (5) is raised and lowered by means of a lifting arrangement including lifting devices where each lifting device preferably are provided at the corners of the frame construction.

4. The apparatus in accordance with claim 3,
wherein the lifting devices are in the form of screw jacks.

5. The apparatus in accordance with claim 2,
wherein the lifting devices are in the form of screw jacks.

6. The apparatus in accordance with claim 1, wherein the means of a lifting arrangement including lifting devices where each lifting device are provided at the corners of the frame construction.

7. The apparatus in accordance with claim 6,
wherein the lifting devices are in the form of screw jacks.

8. The apparatus in accordance with claim 1,
wherein the lifting devices are in the form of screw jacks.

* * * * *